US006273819B1

(12) United States Patent
Strauss et al.

(10) Patent No.: US 6,273,819 B1
(45) Date of Patent: Aug. 14, 2001

(54) HAND HELD ELECTRONIC GAME WITH SENSORS FOR REALISTIC SIMULATION

(75) Inventors: Kathryn Strauss, Austin, TX (US); Eric Chiang, Tsuen Wan (HK); Brian Ng, Sham Shui Po (HK); Isaac Lee, Sheung Shui (HK); Zhou Hui Bao, Wu Gang (CN); Steve Bristow, San Rafael; David Wirt, Richmondview, both of CA (US)

(73) Assignee: Radica China Limited (VG)

( * ) Notice: Subject to any disclaimer, the term of this patent is extended or adjusted under 35 U.S.C. 154(b) by 0 days.

(21) Appl. No.: 09/494,249

(22) Filed: Jan. 31, 2000

(51) Int. Cl.[7] ..... A63F 9/24
(52) U.S. Cl. ..... 463/36; 463/46; 463/37
(58) Field of Search ..... 463/36, 37, 46, 463/47, 30, 31; 273/148.3; 345/156, 157, 158; 473/54

(56) References Cited

U.S. PATENT DOCUMENTS 4,927,987 * 5/1990 Kirchgessner ..... 345/156 X
5,232,223 * 8/1993 Dornbusch ..... 273/148 B
5,516,105 * 5/1996 Eisenbrey et al. ..... 273/148 B
5,542,672 * 8/1996 Meredith ..... 463/37
5,685,776 * 11/1997 Stambolic et al. ..... 463/46
5,730,655 * 3/1998 Meredith ..... 463/37
5,741,182 * 4/1998 Lipps et al. ..... 463/36
5,751,273 * 5/1998 Cohen ..... 345/156
6,106,392 * 8/2000 Meredith ..... 463/36 X

FOREIGN PATENT DOCUMENTS 45-19131 6/1970 (JP) .

* cited by examiner

*Primary Examiner*—Raleigh W. Chiu
(74) *Attorney, Agent, or Firm*—Roylance,Abrams,Berdo & Goodman, L.L.P.

(57) ABSTRACT

A hand held electronic game having sensors requiring the user to perform functions similar to those required during the activity simulated by the game. In a hand held electronic bowling game, both finger-movement sensors and game-moving sensors require the user to grip and swing the game housing much like swinging a bowling ball while finger-receiving sensors measure movement in the fingers and game housing-movement sensors measure the forcefulness and speed of the user's swing with the ball. The sensors include printed circuit boards and the game-moving sensor can utilize a LED and a photodiode along with a periodically transparent extension, which moves between the LED and the photodiode to determine the force of the swing by centrifugal force.

23 Claims, 5 Drawing Sheets

FIG.1
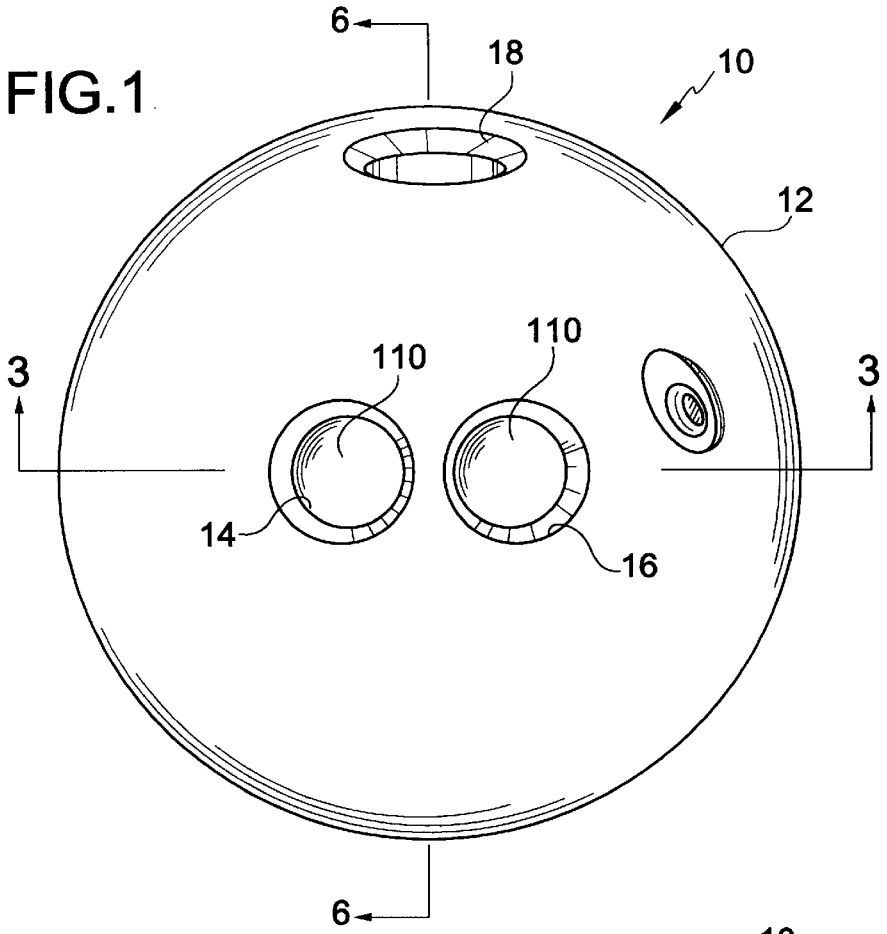
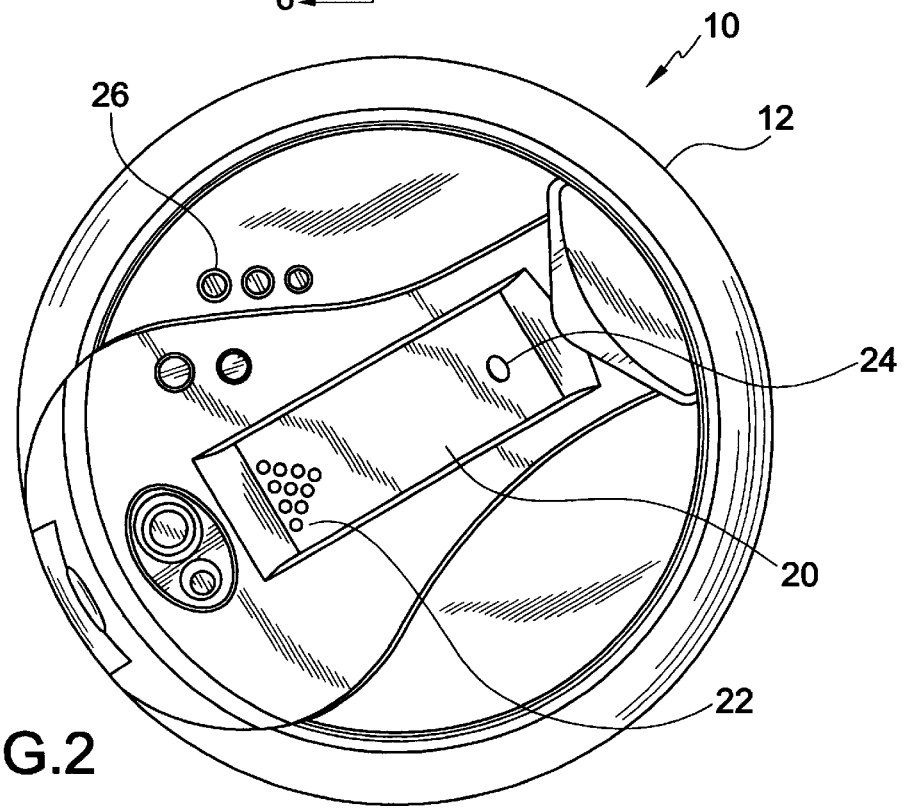
FIG.2

FIG.5
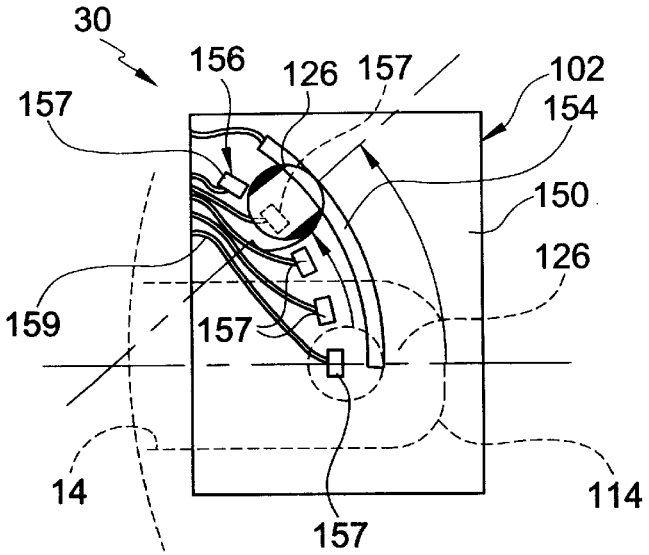
FIG.5a
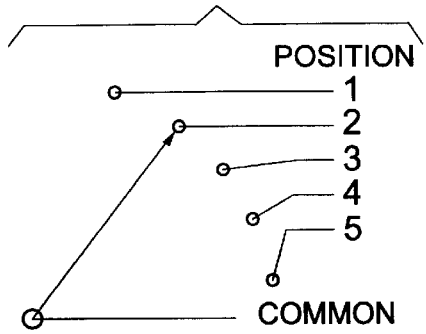
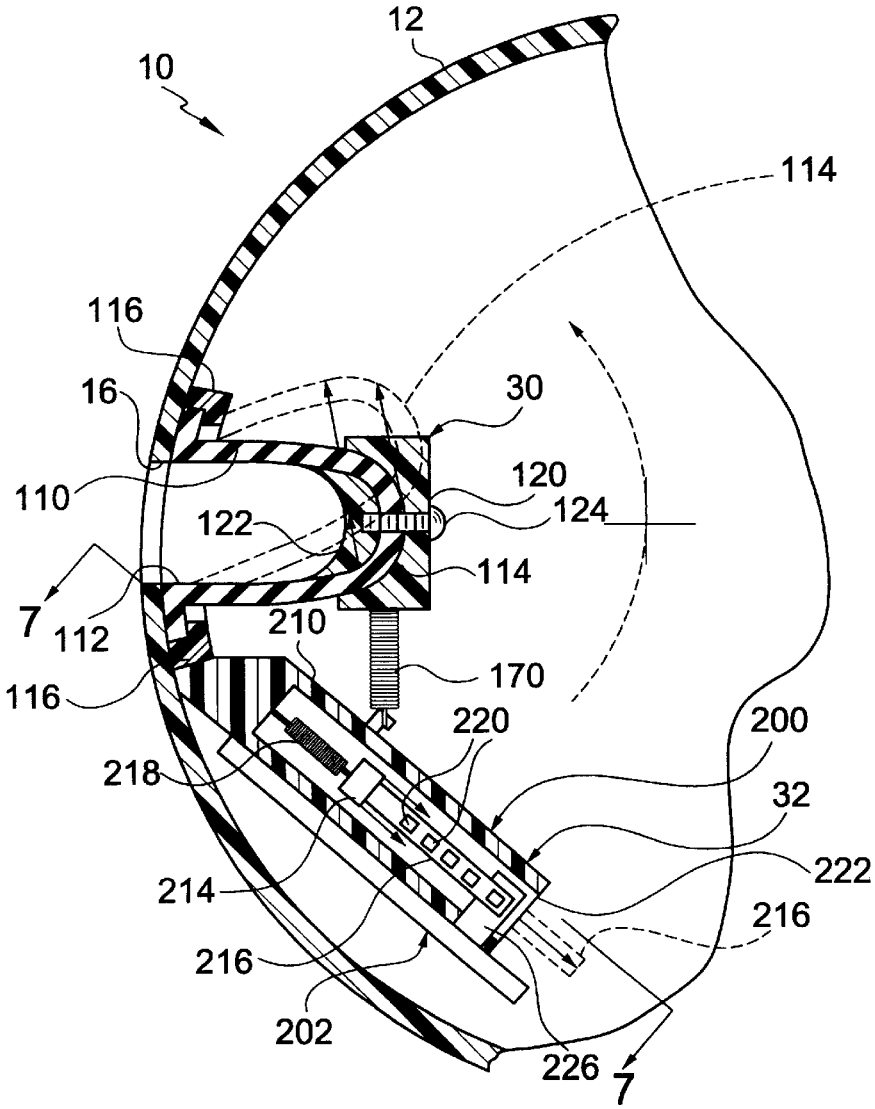
FIG.6

FORCE
TIME
COUNT
STEPS
TIME

FORCE
TIME
COUNT
STEPS
TIME

HAND HELD ELECTRONIC GAME WITH SENSORS FOR REALISTIC SIMULATION

FIELD OF THE INVENTION

The invention relates generally to a hand held electronic game for more realistically simulating an activity. More specifically, the invention relates to sensors that require a user to perform functions similar to those performed during the activity simulated by the game or device in order to determine inputs for playing the game. In the preferred embodiment both finger-movement and ball housing-movement sensors positioned within a hand held electronic bowling game determine the movement characteristics of an electronic ball while playing the electronic game.

BACKGROUND OF THE INVENTION

Prior art hand held electronic games, such as for bowling, generally, if at all, use crude mechanisms to determine traveling characteristics of the ball, such as ball direction and ball force. These prior art devices are lacking in a number of ways. The most glaring deficiency stems from the prior art's inability to simulate actual movements of an individual performing the activity simulated by the electronic device.

For example, the prior art commonly uses buttons and joysticks to determine direction of the ball and simple on-off switches to determine movement of the ball. More complicated systems requiring potentiometers with a spring loaded mass attached to the shaft and spring loaded weights with mechanical switching devices are also known but these systems are expensive, complex, and require precision manufacturing.

Thus, there is a continuing need to provide inexpensive yet realistic hand held electronic devices that are simple and easy to manufacture and assemble. This invention addresses this needs in the art as well as other needs, which will become apparent to those skilled in the art once given this disclosure.

SUMMARY OF THE INVENTION

One object of the present invention is to provide an increased simulation effect for hand held electronic games.

Another object of the invention is to provide uncomplicated and inexpensive mechanisms to simulate a game electronically.

Yet another object of the invention is to provide both finger and ball sensors in a electronic bowling game to determine the traveling characteristics of an electronic ball.

A further object of the invention is to provide sensors for electronic games that permit the user to realistically simulate the activities associated with the real games.

The foregoing objects are basically attained by providing a hand held electronic game, comprising: a housing; a finger activated element coupled to the housing at a fixed end, and having a first finger receiving area and an actuating element coupled to a free end, the first finger activated element being capable of moving between a first position and a second position and the finger receiving area having an open end adjacent the fixed end and a closed end adjacent the free end; and a finger-movement sensing device rigidly coupled to the housing and coupled to the actuating element at both the first position and the second position.

The foregoing objects are also attained by providing a hand held electronic game, comprising: a housing; a housing-movement sensing device rigidly coupled to the housing, the device including a resilient element coupled to a weight-extension assembly, the resilient element coupled between the housing and the weight-extension assembly and the weight-extension assembly capable of moving upon movement of the housing; a light source; and a light sensor for receiving light from the light source, the weight-extension assembly having an extension positioned between the light source and the light sensor.

The foregoing objects are further attained by providing a hand held electronic game, comprising: a housing; a finger activated element coupled to the housing at a fixed end, and having a first finger receiving area and an actuating element coupled to a free end, the first finger activated element being capable of moving between a first position and a second position and the finger receiving area having an open end adjacent the fixed end and a closed end adjacent the free end; a finger-movement sensing device rigidly coupled to the housing and coupled to the actuating element at both the first position and the second position; a housing-movement sensing device rigidly coupled to the housing, the device including a resilient element coupled to a weight-extension assembly, the resilient element coupled between the housing and the weight-extension assembly and the weight-extension assembly capable of moving upon movement of the housing; a light source; and a light sensor for receiving light from the light source, the weight-extension assembly having an extension positioned between the light source and the light sensor.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

Referring now to the attached drawings, which form a part of this disclosure.

FIG. 1 is a top view of a hand held electronic bowling game in accordance with the present invention showing the finger openings on the spherical portion of the game;

FIG. 2 is a bottom view of the hand held electronic bowling game in accordance with the present invention showing the display and control section on the planar portion of the game;

FIG. 5 is a cross-sectional view of the game illustrated in FIG. 3, taken along line 5—5 showing the wiper PCB and the movement of the contact there along from an at-rest position in solid lines to a gripped position in dashed lines wherein the finger elements have pivoted as moved by the fingers and the contact has moved along to the wiper PCB in an amount corresponding to the movement of the fingers of the user;

FIG. 5*a* is circuit diagram illustrating the switch created by the finger movement sensing device 102;

FIG. 6 is a cross-sectional view of the game illustrated in FIG. 1, taken along line 6—6 and showing the movement of the finger boots and the force sensor assembly in an at-rest position in solid lines and in a second, game-swinging position in dashed lines;

DETAILED DESCRIPTION OF THE PREFERRED EMBODIMENTS

Figure 3:
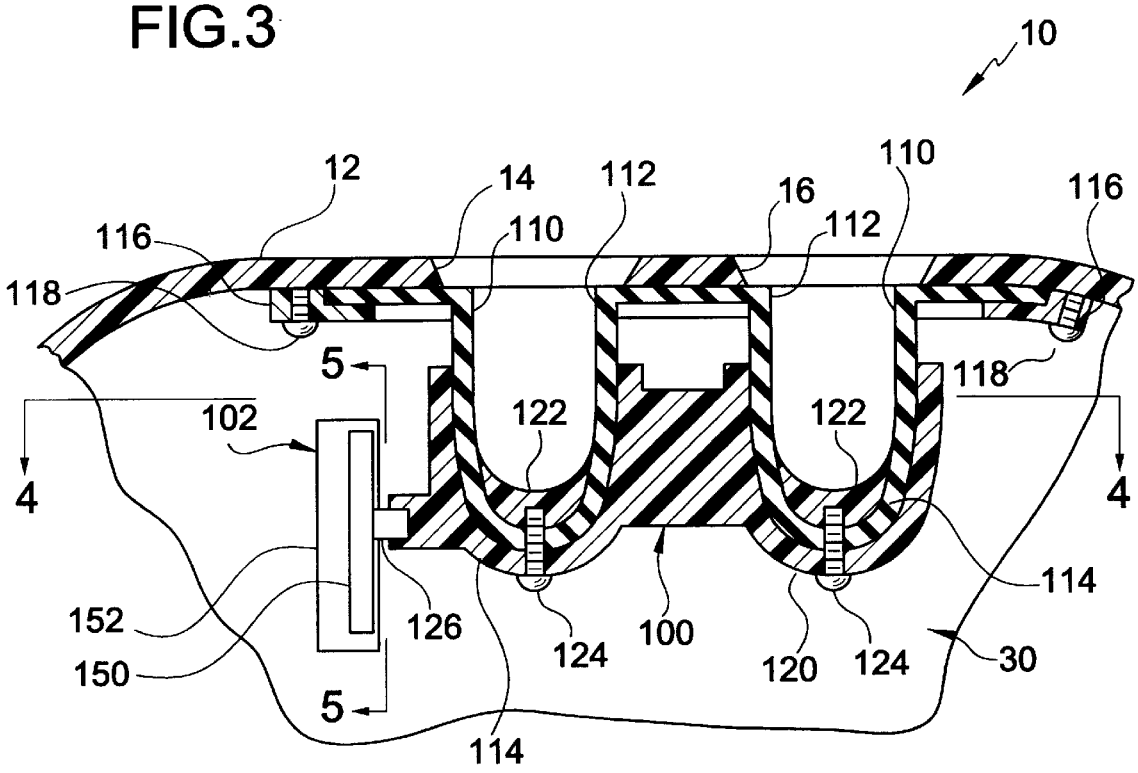
FIG. 3 is a cross-sectional view of the game illustrated in FIG. 1, taken along line 3—3 showing the finger-activated control assembly.

The subject invention preferably relates to a hand held bowling game 10 that is styled in the shape of a bowling ball. Preferably, the game 10 includes a housing 12 that is generally spherical. More, specifically, housing 12 has a spherical portion with finger openings 14, 16 and 18 for receiving fingers 19 of a user and a more planar portion containing a display 20. Thus, housing 12 is preferably a truncated sphere. The display 20 includes a liquid crystal display of a bowling lane with electronic pins 22 and an electronic ball 24. Control switches 26 and a sound speaker are also located on the planar portion. Together, the control switches, electronic circuits, sound speaker, and a set of unique controls within the finger openings 14 and 16 and within the housing 12 and an on-board microprocessor create a realistic simulation of a bowling game.

As seen in FIGS. 1–8, housing 12 is generally styled to look like a bowling ball with the top end cut off so that a flat space exists to mount the display 20 and buttons 26 thereon. Finger openings or holes 14, 16 and 18 in the bottom of the housing 12 are for the thumb and a pair of fingers, as in a real bowling ball. The LCD display 20 is driven by a microprocessor 34 and electronics similar to those used commonly in the LCD game industry. This invention provide a new, more realistic method and apparatus for supplying the inputs into the microprocessor 34. Those inputs coming from a finger activated control assembly 30 for determining the direction the ball will travel down the lane and a force sensor assembly 32 for determining the force exerted by the use in swinging game 10, which determines the force ball 24 will act on pins 22. Ten bowling pins 22 upon a simulated lane and a ball 24 are illustrated on the display 20.

FIGS. 3–6 illustrate a sectional view of the bottom of the housing 12 showing a finger activate control assembly 30 in the form of a finger element 100 and a finger-movement sensing device 102. The finger element 100 includes two finger receiving areas 110. Preferably, each finger receiving area 110 is a flexible boot made of resilient material such as rubber and molded into the shape of a finger tip. Each boot 110 has a fixed end 112 and a free end 114. The fixed end 112 being preferably clamped to the inside of the ball housing 12 by a retaining ring 116. This ring 116 is preferably affixed by mounting screws 118 so that the boots 110 are trapped at their respective base and capable of being pivoted about their respective bases.

At the free end 114 of each boot 110, a contact mounting plate 120 is preferably attached by a retaining plug 122 and a fastener, such as a screw 124. The screws 124 clamp the free end 114 of the boots 110 between the mounting plate 120 and its respective retention plug 122. On the side of the mounting plate 120 a contact 126 is rigidly affixed in a conventional manner. As will be shown later this contact 126 will be used to wipe over a contact board 150 when the user flexes his two fingers within the finger elements 100 and causes the boots 110 to flex. Since the game 10 is preferably gripped as a bowling ball, the middle finger and the ring finger of the user are inserted into boots 110 while the thumb of the user is inserted into the third finger opening 18. The gripping of the two fingers in boots 110 will move the boots 110 and this movement will dictate an affect on electronic ball 24.

Contact board 150 is a wiper printed circuit board rigidly mounted to housing by a mount 152. Wiper PCB 150 has, on its surface, two main trace areas. The first area 154 is a continuous arc for the common segment. The second area 156 includes a number of individual contact pads 157 arranged in an arc also. Each of these conductive areas 154 and 156 is connected by smaller conductive traces 159 to the edge of the wiper PCB 150 so that they may be electrically wired to the main electronics PCB 34. When the contact 126 is pressed against the wiper PCB 150 it connects the common trace 154 to differing areas of the wiper PCB 150. In effect, the combination of the moving contact 126 and the wiper PCB 150 create the electrical equivalent of the multiple pole selector switch shown in FIG. 5*a*. When the user flexes his or her fingers 19 the contact 126 is swept over the surface of the wiper PCB 150 as the mounting plate 120 translates and mirrors the user's finger motion. In other words, the contact 126 preferably moves along with and the same extent as the fingers of the user.

Figure 4:
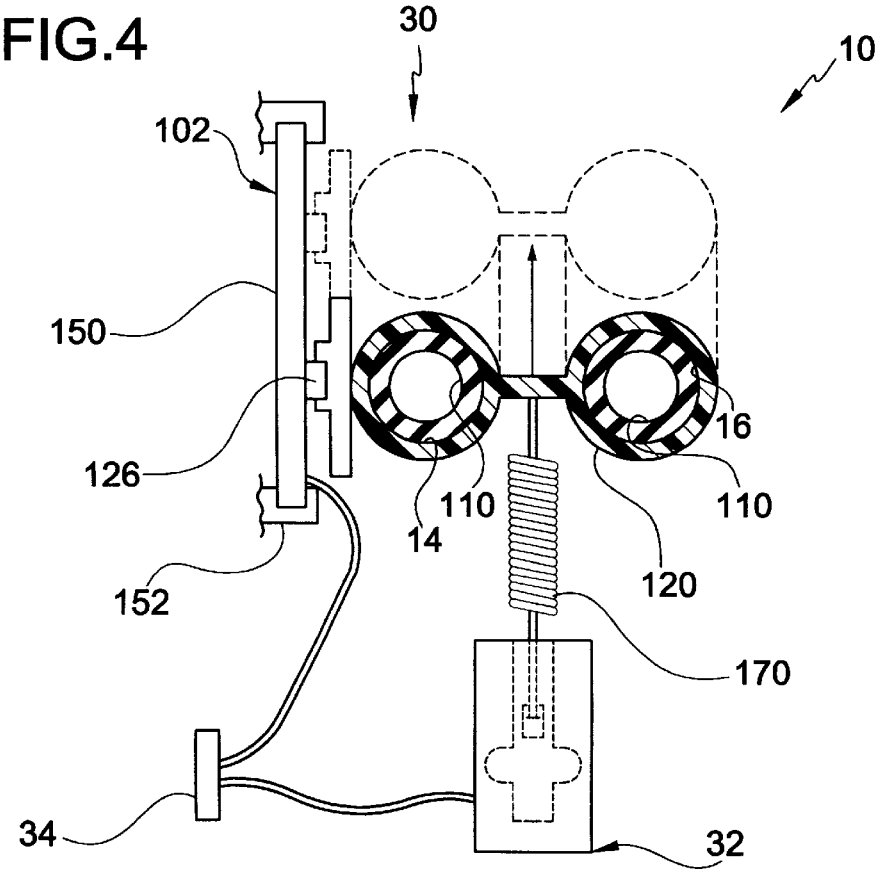
FIG. 4 is a cross-sectional view of the game illustrated in FIG. 3, taken along line 4—4 showing the movement of the finger elements from an at-rest position in solid lines to a gripped position in dashed lines wherein the finger elements have pivoted, as moved by the fingers, and the contact has moved along to the wiper PCB an amount corresponding to the movement of the fingers of the user.

FIGS. 4, 5 and 6 show how the user can flex his or her fingers 19 and cause boots 110 to bend. An unbent boot 110, at rest, is shown in solid lines in FIGS. 4 and 6 and in dashed lines in FIG. 5. A bent boot 110, moved by force applied by the fingers 19 is shown in dashed lines in FIGS. 4 and 6. It is this flexure that causes the wiper or contact 126 to slide along the wiper PCB 150 and signal to the main electronics PCB 34 that the user or player is selecting some amount of "spin" on the virtual, electronic ball 24. The finger element 100 is biased in an at-rest position by the resiliency of boots 110 but can be further biased by a resilient, biasing element 170 preferably in the form of a spring rigidly coupled to housing 12. As seen in FIG. 6, this connection can occur via force sensor assembly 32.

Finger actuated control assembly 30 allows the player to select the mount of hook desired. The player flexes his or her fingers 19 to actuate the wiper 126 whose position is sensed by the microcontroller 150. The degree of flex of the fingers 19 and boots 110 is proportional to the spin that is placed on the simulated ball 24. This action mirrors that way that a traditional, real bowler puts a spin on the ball by squeezing his or her hand as the ball is released. Since the thumb releases first out of the ball the amount of squeeze is proportional to the amount of spin put on the ball. The boots 110 also allow the inside of the game to be sealed from contaminates because the boots 110 not only provide a spring restoring force to the finger elements 100, but also seal the inside of the game housing 12 from any outside contamination. The switch mechanism chosen provides for an easy to sense switch based input that allows the microprocessor to directly read the position of the player's fingers at any time.

Figure 7:
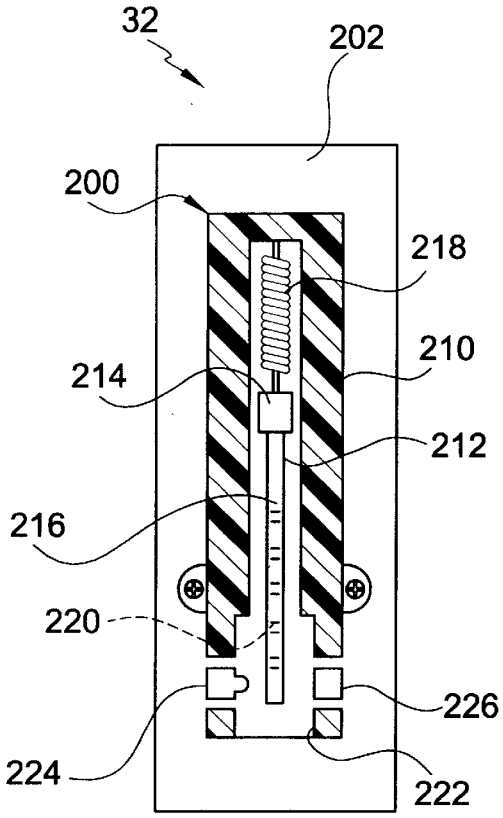
FIG. 7 is a cross-sectional view of the game illustrated in FIG. 6, taken along line 7—7 and showing the weight-extension assembly in a first, at rest, position.
Figure 8:
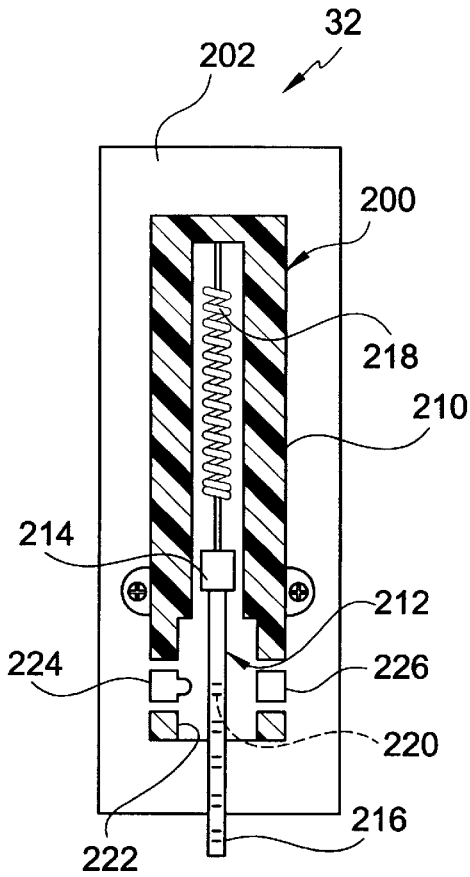
FIG. 8 is a cross-sectional view similar to FIG. 7 but illustrating the weight-extension assembly in a second position, when the game is being moved, which is when the user is swinging the game housing.

Finger activated control assembly 30 can be used by itself without other inputs into the main electronics PCT 34 or can be used with other control assemblies. For example, finger activated control assembly 30 can be used together with another input in order to even more accurately simulate the throwing of a bowling ball and control the electronic ball 24. That is PCB 34 can receive input to know when the player starts the swing and how hard the player is swinging. As shown in FIGS. 6–8, a force sensor assembly or acceleration sensor 32 can be rigidly mounted within the ball housing 12. Sensor assembly 32 has a housing-movement sensing device or force sensor 200 coupled to a printed circuit board 202. Sensor assembly 32 is so mounted that when the player swings the ball housing 12, the centrifugal force resulting from the swing is oriented towards the top end of the ball housing 12, or towards the display 20 located opposite finger openings 14, 16 and 18. The harder the ball housing 12 is swung, the more force will be seen by the sensor assembly 32.

Force sensor 200 preferably includes a cover 210 secured to the PCB 202 with a weight-extension assembly 212 connected to cover 210 by a resilient element 218 such as a spring. The weight-extension assembly 212 includes a mass or weight 214 and an extension or blade 216. The spring loaded mass 214 and the blade 216 can be integrally formed as a unitary piece or can be separate elements secured together. Preferably, blade 216 has apertures or perforations 220. At rest, the mass 214 is biased by the spring 218 to be located at the right end or spring end of the cover 210. During a swing, the centrifugal force causes the mass 214 to move toward an open end 222 of cover 210. The amount of displacement of mass 214 is proportional to the amount of centrifugal force applied by the user while swinging the ball housing 12. The amount of centrifugal force is proportional to the speed of the swing.

FIG. 7 illustrates the position of the blade 216 when the ball is at rest. FIG. 8 illustrates the position of the blade 216 when the ball housing 12 is being swung at the maximum sensible rate. In this case, the weight 214 and the perforated blade 216 have moved the maximum amount towards the open end 222 of cover 210. Also shown in FIGS. 7 and 8, an infrared LED light source 224 and a phototransistor light detector, or photo sensor or light sensor 226, which are both mounted with the sensor 32 on PCB 202 for ease of assembly. As the perforated blade 216 translates toward the open end 222 of cover 210 during a swing due to the centrifugal force, the holes 220 in the perforated blade 216 sequentially pass between the IR source 224 and the phototransistor 226 as the blade 216 moves toward the open end 222 of the cover when the swing is started. The open end 222 of the cover permits the blade 216 to extend through the cover 210 as seen in FIG. 8. A harder the swing of the game housing 12 results in a greater centrifugal force, which results in the blade extending further away from its at-rest position, which results in a larger number of holes 220 passing between light source 224 and light sensor 226. When the swing ceases, the blade 216, biased by the spring 218, retracts toward the spring 218 and the holes 220 in the perforated blade 216 sequentially pass back between the IR source 224 and the phototransistor 226 as the blade 216 moves toward spring 218 and toward its at-rest position as the swing stops. Thus, through the light sensor 226 receiving a beam of light from light source 224 each time a hole 220 passes there between, the main game controller 34 can determine the force of the swing by counting the number of times the light is transmitted though blade 216— a higher count means a stronger swing and a lower count means a less forceful swing. Another advantage of this system is that since the sensing is done optically, there is no need for a precision fit or tight tolerances with respect to sensor 32. Therefore, sensor 32 can be merely laid on top of the PCB 202 and loosely held in place by dust cover 210.

Figure 9:
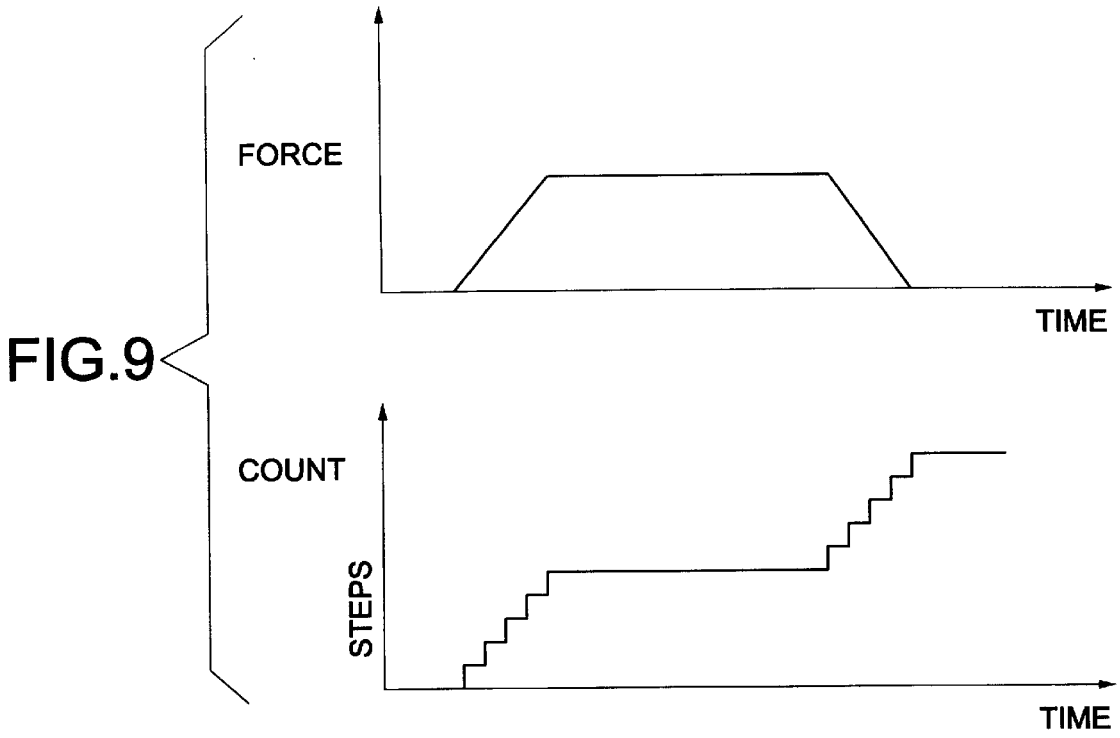
FIG. 9 contains two graphs illustrating the functioning of the sensors during a forceful swing of the game housing.
Figure 10:
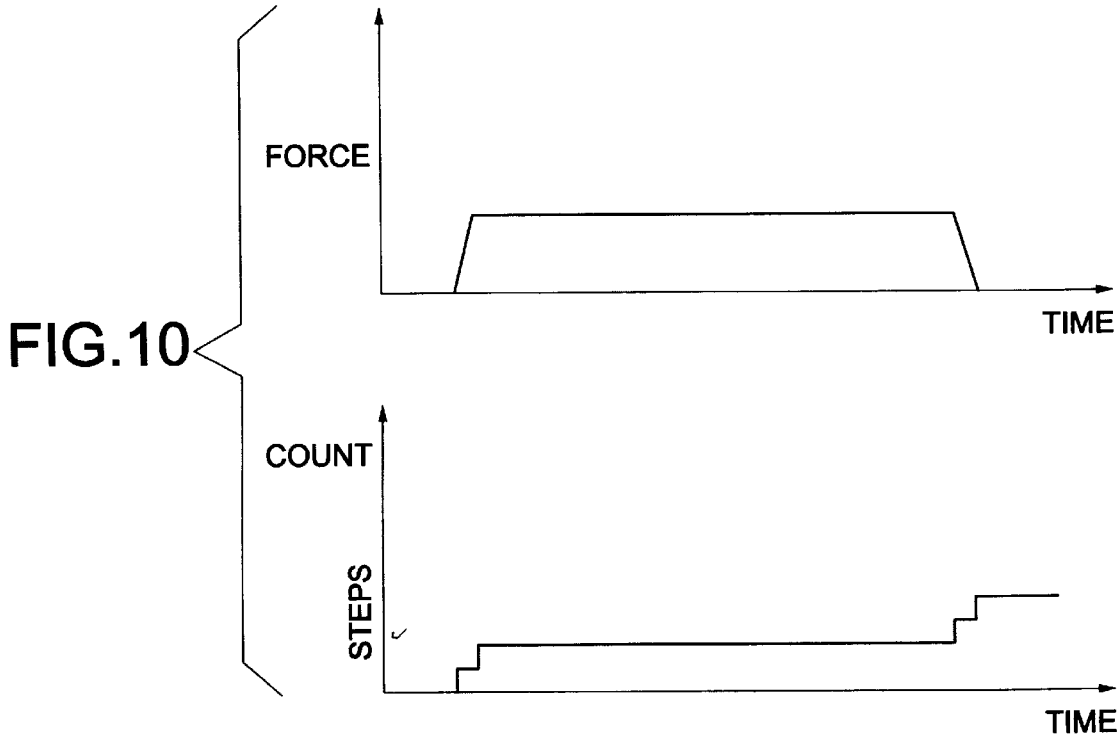
FIG. 10 contains two graphs illustrating the functioning of the sensors during a less forceful swing of the game housing than in FIG. 9.

FIGS. 9 and 10 show how the microprocessor in the electronics PCB 34 can determine the speed and timing of the swing. The top graphs in FIGS. 9 and 10 show the intensity of the swing over time. The bottom graphs in FIGS. 9 and 10 show how the total number of counts sensed ramps up as the swing is completed. The microcontroller can use the total count to determine the speed of the swing. The microcontroller can use the time between the two bursts of counts to determine the length of the swing. Of course, although the force sensor assembly 32 is disclosed and illustrated as being used together with finger activated control assembly 30, force sensor assembly 32 can be used by itself, or with other, different sensor assemblies.

Figure 11:
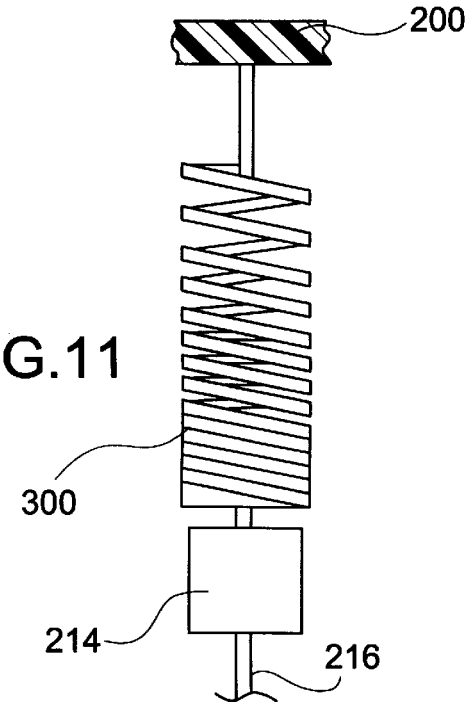
FIG. 11 illustrates a variable spring in accordance with a second embodiment of the present invention, with variable twists per inch.
Figure 12:
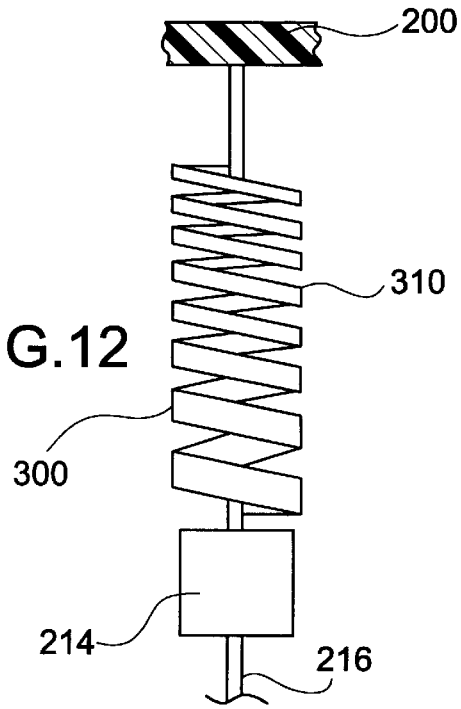
FIG. 12 illustrates a variable spring in accordance with a third embodiment of the present invention, with a variable spring wire diameter.

FIGS. 11 and 12 illustrate second and third embodiments of the invention with respect to the biasing of the weight-extension assembly 212 and pertains to the ability to measure low forces accurately while still being able to measure large forces.

Because, ordinary springs are linear, they compress or stretch in a manner directly proportional to the force applied. This works well for a sensor that sees a moderate range of forces, but if one is trying to measure accurately the velocity of, for instance, a golf club while putting, while still wanting to measure the speed of a simulated drive by the golf club in a simulated golf game, one runs out of room for the spring. In order to make a reasonably sized sensor it typically must be optimized to measure either a small or a large force.

Automobiles have a similar problem in trying to size the springs in a car to handle both the small shocks of normal driving and the large shocks of potholes. Too soft a spring gives a nice ride, but the suspension bottoms out over a pothole. Too hard a spring prevents bottoming out, but leads to a harsh normal ride. Like our case, the automobile has only a fixed length in which to place as spring.

Variable rate springs are one solution. These are springs whose resistance or spring rate depends on how far they have been compressed. At the beginning they are soft, but as pressed further their rate goes up so they can handle a larger force. This variable rate can be accomplished by winding the spring with a variable number of turns per inch as seen in spring 300 illustrated in FIG. 11 or by means of winding the spring with spring wire whose diameter changes over the length of the spring as seen in spring 310 illustrated in FIG. 12. Either way it is done by using variable rate springs and it enables the ability to sense, for example, both a putt and a drive of an electronic golf game.

While the subject disclosure herein has been described with respect to a hand held LCD bowling game, the principals of the sensor systems can be used easily for other game formats and for other game systems. For example, a controller for a personal computer or PC based bowling game could be built using the principals taught by this invention. A bocci ball game system could be built using the sensing systems described above. The sensors could also be used to measure the swing speed of a baseball bat or of a golf club or the spin applied to a baseball, basketball, or any other hand actuated device. The utility of the invention is limited only by the desires of the user who wished to apply it.

Further, although some specific materials and structure for the game 10 and its sensors 30 and 32 is illustrated and disclosed it should be understood that other materials and structure can be used. For example, although the finger element is disclosed as comprising a number of elements attached by fasteners, a single, unitary, integrally formed element could be used.

While advantageous embodiments have been chosen to illustrate the invention, it will be understood by those skilled in the art from this disclosure that various changes and modifications can be made therein without departing from the scope of the invention as defined in the appended claims.

What is claimed is:

1. A hand held electronic game, comprising:

a housing;

a finger element coupled to said housing at a fixed end, and having a first finger receiving area and an actuating element coupled to a free end, said finger element being capable of moving between a first position and a second position and said finger receiving area having an open end adjacent said fixed end and a closed end adjacent said free end; and a finger-movement sensing device rigidly coupled to said housing and coupled to said finger element at both said first position and said second position.

2. A game according to claim 1, wherein said housing is generally in the shape of a sphere.

3. A game according to claim 2, wherein said housing is a truncated sphere.

4. A game according to claim 1, wherein said housing has a second finger receiving area having an open end and a closed end.

5. A game according to claim 4, wherein said housing has a third finger receiving area directly coupled to said first finger receiving area.

6. A game according to claim 1, wherein said first finger receiving area is biased in said first position by a spring coupled between said housing and said finger receiving area.

7. A game according to claim 1, wherein said finger-movement sensing device includes a printed circuit board.

8. A hand held electronic game, comprising:

a housing; and a housing-movement sensing device rigidly coupled to said housing, said device including a resilient element coupled to a weight-extension assembly, said resilient element coupled between said housing and said weight-extension assembly and said weight-extension assembly capable of moving upon movement of said housing, said sensing device further having a light source, and a light sensor for receiving light from said light source, and said weight-extension assembly having an extension positioned between said light source and said light sensor.

9. A game according to claim 8, wherein said housing is generally in the shape of a sphere.

10. A game according to claim 9, wherein said housing is a truncated sphere.

11. A game according to claim 8, wherein said housing has a three finger receiving areas, each of said areas having an open end and a closed end.

12. A game according to claim 8, further comprising:

a printed circuit board coupled to said housing-movement sensing device, said light source, and said light sensor.

13. A game according to claim 12, wherein said housing-movement sensing device has a cover attached to said printed circuit board and overlying said resilient element and said weight-extension assembly.

14. A game according to claim 13, wherein said resilient element is a spring coupled to said housing through said cover.

15. A game according to claim 8, wherein said weight-extension assembly including a metallic weight attached to a plastic extension.

16. A game according to claim 8, wherein said light source is a light emitting diode.

17. A game according to claim 8, wherein each of said light source and said light sensor are coupled to a printed circuit board.

18. A game according to claim 8, wherein said extension has a plurality of holes extending completely there through.

19. A game according to claim 8, wherein said extension has indicia.

20. A hand held electronic game, comprising:

a housing;

a finger element coupled to said housing at a fixed end, and having a first finger receiving area and an actuating element coupled to a free end, said finger element being capable of moving between a first position and a second position and said finger receiving area having an open end adjacent said fixed end and a closed end adjacent said free end;

a finger-movement sensing device rigidly coupled to said housing and coupled to said finger element at both said first position and said second position; and a housing-movement sensing device rigidly coupled to said housing, said device including a resilient element coupled to a weight-extension assembly, said resilient element coupled between said housing and said weight-extension assembly and said weight-extension assembly capable of moving upon movement of said housing, said sensing device further having a light source, and a light sensor for receiving light from said light source, and said weight-extension assembly having an extension positioned between said light source and said light sensor.

21. A game according to claim 14, wherein said spring is a variable-rate spring.

22. A game according to claim 21, wherein said variable-rate spring varying turns-per-inch.

23. A game according to claim 21, wherein said variable-rate has a varying spring wire diameter.

* * * * *